United States Patent [19]

Amberg et al.

[11] 4,184,604

[45] Jan. 22, 1980

[54] DRINKING LID

[75] Inventors: Christopher P. Amberg, Sylvania, Ohio; Samuel L. Belcher, Clementon, N.J.

[73] Assignee: Owens-Illinois, Inc., Toledo, Ohio

[21] Appl. No.: 944,664

[22] Filed: Sep. 21, 1978

[51] Int. Cl.[2] ..... A47G 19/22

[52] U.S. Cl. ..... 220/254; 220/90.4; 220/367; 220/380; 229/7 R; 229/43

[58] Field of Search ..... 220/90.4, 268, 254, 220/380, 367; 206/508, 503, 509; 229/7 R, 43

[56] References Cited

U.S. PATENT DOCUMENTS

| | | | |
|---|---|---|---|
| 2,176,898 | 10/1939 | Fried | 220/268 |
| 3,015,411 | 1/1962 | Smith | 220/90.4 |
| 3,355,058 | 11/1967 | Asbury | 220/268 |
| 3,868,043 | 2/1975 | Freemyer | 220/90.4 |
| 3,895,743 | 7/1975 | Christian | 206/508 X |
| 3,927,794 | 12/1975 | Erdman | 220/268 |
| 3,977,559 | 8/1976 | Lombardi | 220/90.4 |
| 3,994,411 | 11/1976 | Elfelt | 220/90.4 |
| 4,106,660 | 8/1978 | Boyle | 220/90.4 |
| 4,113,135 | 9/1978 | Yamazaki | 220/90.4 X |

*Primary Examiner*—Allan N. Shoap

*Attorney, Agent, or Firm*—David R. Birchall; Myron E. Click; David H. Wilson

[57] ABSTRACT

Disclosed is a lid for a container which is designed to allow drinking of the contents while the lid is in place and to prevent spillage of the contents. The lid includes a generally circular body member and a sealing edge located along the periphery of the body member. A raised platform is integrally formed on the body member and is bounded by the periphery of the body member and an upstanding wall portion generally defined by a chord of the body member. A flipper valve is located on the platform and is generally radially aligned and hinged near the wall portion. The valve includes an integrally formed protrusion which provides a place for application of downward pressure to open the valve. The valve is such that lip pressure is sufficient to cause the valve to open. The platform provides a flat area extending to the edge of the container which allows the lip to make a complete seal over the portion of the lid which it contacts. A plurality of stacking lugs whose upper surfaces are equal in elevation to the top of the protrusion on the valve with respect to the body member, can be located on the body member in order to define, along with the top of the protrusion, a stacking plane for the lid.

5 Claims, 4 Drawing Figures

DRINKING LID

BACKGROUND OF THE INVENTION

This invention relates to lids for containers. More particularly, this invention relates to lids which are designed to permit the drinking of the contents of the container while the lid is still in place. Still more particularly, this invention relates to drinking lids which may be stacked and dispensed in a coin type fashion. It is well known to provide lids for drinking containers to prevent the spillage of the contents of the container. Many lids incorporate an opening in order to allow drinking of the contents either in the normal drinking fashion or by the insertion of a straw or the like. Several lids, such as those described in U.S. Pat. Nos. 3,994,411 and 3,977,559, utilize a resealable drinking flap in order to prevent the sloshing of the contents out of the container. Other lids, such as those described in U.S. Pat. Nos. 2,176,898 and 3,355,058, utilize a depressable tab which when depressed, provide a suitable opening for either drinking from the container or pouring the contents from the container. U.S. Pat. No. 3,927,794 describes a lid with a tab which also includes a means for locking the tab to its open position. All of the above described lids are either opened permanently after their initial opening or must be manually resealed. One device, however, which is described in U.S. Pat. No. 3,015,411, provides for the opening and closing of a container lid simply by the application or the releasing of pressure from the lips of a drinker. This device is fairly complicated however, and therefore does not lend itself to use with typical throwaway containers, such as those used in the fast food industry.

It is also well known in the art to provide stacking lugs so that lids may be stacked and dispensed in a coin-type fashion. The shapes of many lids are such that without any type of stacking lugs they would nest with each other, thus preventing easy dispensing. By including stacking lugs in the lids, a stacking plane is defined above the surface of the lid. The lugs then slide across the lower plane surface of the lid, thus allowing for convenient coin-type dispensing. Some lids have the stacking lugs formed so that they project downwardly from the lid and the stacking plane is thus formed on the under side of the lid. The basic idea however, is to have one relatively flat surface which defines the first stacking plane and a plurality of stacking lugs which define a second stacking plane. The stacking lugs then slide across the flat surface of the lid as it is dispensed.

SUMMARY OF THE INVENTION

The present invention provides a drinking lid for a container which is both simple in construction and may be opened by the lips of a drinker. The lid remains closed until the drinker takes a drink, and then is opened during that time. Once the drinker has finished taking a drink, the lid will automatically close, thus preventing the spillage of any of its contents. In addition, the lid is formed in such a way that the lips make a complete seal with the lid, thus preventing further chance of spillage while the drinker is drinking. The construction of the lid also allows for coin-type stacking.

The invention comprises a lid for container which is designed to allow drinking of the contents without the removal of the lid. The lid includes a generally circular body member and a seal edge located along the periphery of the body member. A raised platform is integrally formed on the body member and bounded by the periphery of the body member and the upstanding wall portion which is generally defined by a chord of the body member. The lid includes a flipper valve located on the platform which is generally radially aligned and hinged near the wall portion. The valve includes an integrally formed protrusion which provides a place for the application of downward opening pressure to the valve. The valve is opened by pressure from the upper lip of the drinker when the container is brought to the drinker's mouth in a drinking fashion. The platform provides a relatively flat surface from the valve to the edge of the container, thus allowing the lip to make a complete seal over the portion of the lid which it contacts. The valve recloses when the lip pressure is removed, thus preventing any spillage of the contents of the container. In order to allow coin-type stacking and dispensing lids, a plurality of stacking lugs, whose upper surfaces are equal in elevation to the top of the protrusion on the valve with respect to the body member, can be located on the body member.

DETAILED DESCRIPTION OF THE DRAWINGS

Figure 1:
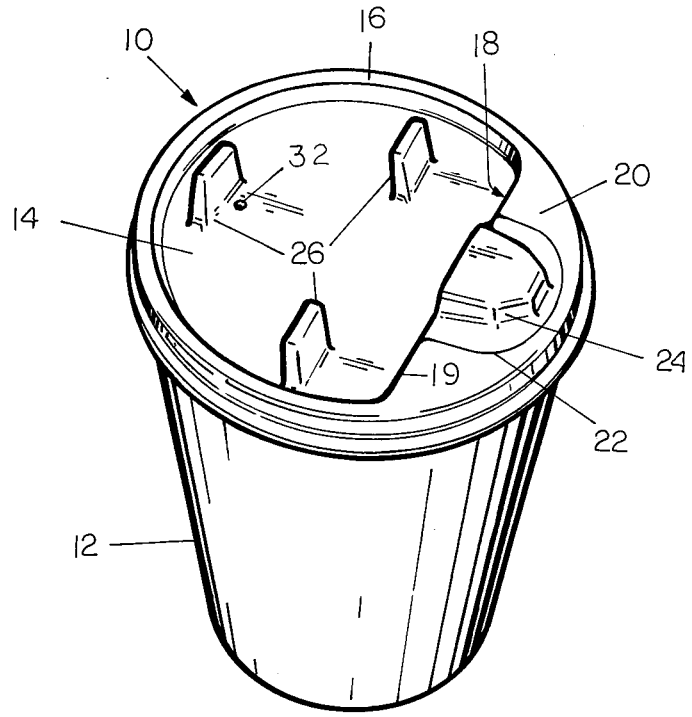
FIG. 1 is a view of the lid of the present invention attached to a container.

Referring to FIG. 1, a container lid 10 is shown attached to a container 12. In the preferred embodiment of the invention, the lid 10 is made of thermoformed plastic material. Thermoforming is a well known method of manufacturing whereby sheets of thin plastic material are heated and then vacuum formed to their desired shape. Excess material is then trimmed away by die cutting. In addition to thermoformed plastic, other common materials, such as injection molded plastic, may be used to form the lid 10. The lid 10 includes a generally circular body member 14 and a seal edge 16 located along the periphery of the body member 14. Various types of seal edges are known in the art, and the seal edge 16 shown in FIG. 1 consists generally of two vertical wall portions connected by a horizontal strip so as to form a generally U-shaped channel which fits over the rim of the container 12. This allows the lid 10 to be securely fastened to the container 12, although it is still removeable due to the flexibility of the thermoformed plastic material which is used to make the lid 10.

Referring further to FIG. 1, a generally vertical wall portion 18, which is defined by a chord 19 of the circular body section 14, connects the body member 14 with a raised platform 2. The platform 20 need not necessarily be defined by a chord of the body member 14, i.e. a curved line could be used to connect two points on the periphery of the body member 14 in order to define the platform 20. Although a U-shaped channel is not formed where the platform 20 meets the seal edge 16, a downwardly extending wall portion still provides securing pressure against the container 12. A radially aligned press and release or flipper valve 22 is formed on the platform 20 during the die cutting process. The valve 22 is generally U-shaped (although this is not critical) and is hinged near the chord 19 and cantilevered towards the seal edge 16 and away from the center of the body member 14. The hinge location is not critical, although the valve action will be somewhat better if the hinge is near the chord 19, due to the stresses caused by the wall 18. An integrally formed protrusion 24 is located on the valve 22, and provides a convenient place for applying a downwardly opening pressure to the valve 22. The resiliency of the thermoformed plastic material is such that when the downward force required to open the valve 22 is removed, the valve 22 will spring back to its original closed position. Thus an effective valve may be formed simply by cutting the U-shaped into the platform 20. Other shapes, such as three sides of a rectangle or a V-shape could also be used to form the valve 22.

Figure 2:
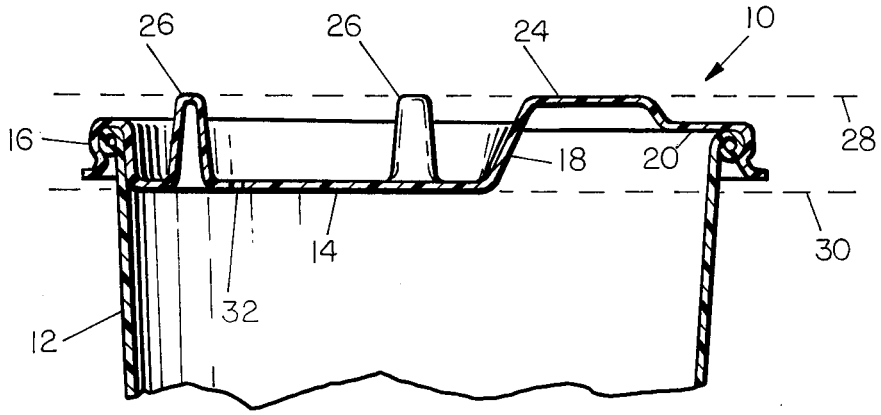
FIG. 2 is a cross-sectional view of the lid of FIG. 1.

Located on the body member 14 are three integrally formed stacking lugs 26, which are conventional in the art and are utilized to permit coin type stacking and dispensing of a plurality of lids. As shown in the cross-sectional view of FIG. 2, the tops of the stacking lugs 26 are at the same height as the top of the protrusion 24 with respect to the body member 14. The tops of the stacking lugs 26 and the top of the protrusion 24 thus define a plane, represented by a dashed line 28, which is generally parallel to the plane of the body member 14, which is represented by a dashed line 30. The protrusion 24 on the valve 22 therefore acts as a stacking lug as well as being utilized to open the valve 22. When a group of lids are stacked, the stacking lugs 26 and the protrusion 24 of one lid come in contact with the lower surface of the body member 14 of another lid. Because of the presence of the raised platform 20, the body member 14 does not present a complete circular surface for contact with the stacking lugs 26 or the protrusion 24. However, the size of the platform 20 is relatively small (it generally takes up less than $\frac{1}{3}$ of the circular space of the body member 14), and at least three of the four surfaces presented by the stacking lugs 26 and the protrustion 24 will contact the body portion 14. These three points are sufficient to define the stacking plane 28, and therefore will allow lids to be stacked in a parallel, or coin type, fashion. By manufacturing lids so that the lower surface of the body member 14 is below any part of the seal edge 16, no resistance is encountered due to overlap of the seal edges when dispensing lids. Because of the flexibility of the thermoformed plastic material, however, coin-type dispensing is still possible even though the seal edge 16 may extend somewhat below the level of the lower surface of the body member 14.

Figure 3:
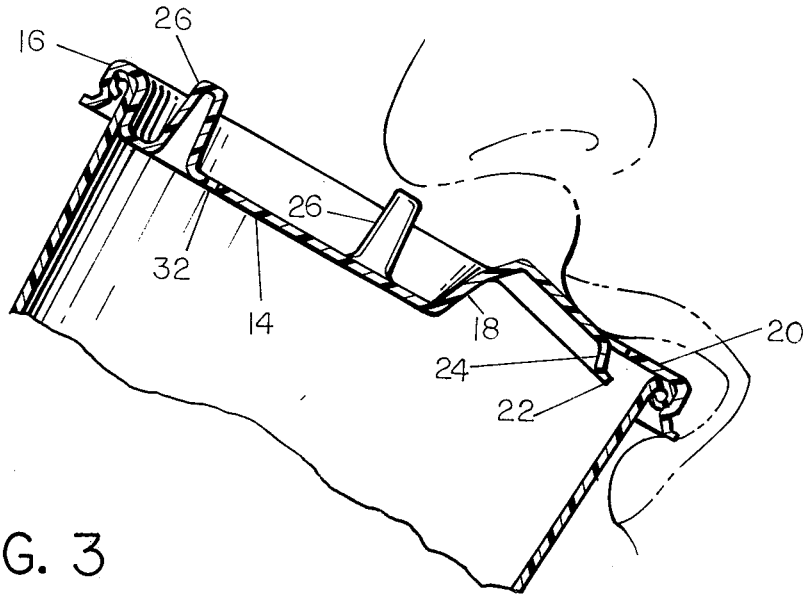
FIG. 3 is a view of a drinker utilizing the lid of FIG. 1.

Although the valve arrangement described may be used for pouring contents from a container by applying finger pressure to the protrusion 24, its primary intended function is for as a drinking lid. Referring to FIG. 3, a drinker is shown with the lid 10 and the container 12 placed to his mouth in a drinking fashion. The upper lip of the drinker initially contacts the protrusion 24 and downward pressure from the lip causes the valve 22 to open. The drinker's upper lip then forms a seal with the surface of the platform 20. The lower lip of the drinker contacts the container 12 in a normal fashion. Thus, by drinking normally, the valve 22 is opened by pressure of the upper lip, allowing liquid to flow out of the container 12. When the drinker removes the container 12 from his mouth, the resiliency of the thermoplastic material will cause the valve 22 to spring back to its closed position. This serves to minimize any spillage which tends to occur due to the sloshing of the contents of the container 12. A vent 32, which may simply be a pin hole type vent, may be located on the body member 14 in order to allow the contents of the container 12 to flow more freely into the drinker's mouth while he is drinking.

Figure 4:
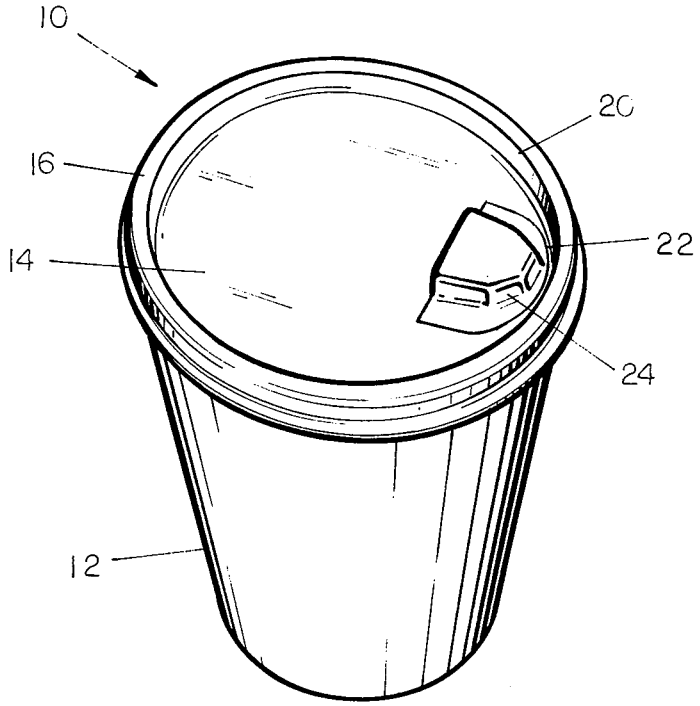
FIG. 4 is a view of a variation of the lid of FIG. 1.

The purpose of the platform 20 is two-fold. Initially, it provides a flat surface from the edge of the container to the valve 22, thus facilitating a complete seal around the valve 22 and the portion of the lid 10 which the drinker's lip contacts. If the platform were absent, the drinker's lip might not form a complete seal with the lid 10 due the upstanding seal edge 16. This is illustrated in FIG. 4. Thus, drinking is easier and the chance of spillage while drinking is reduced because of the presence of the platform 20. In addition, since the body member 14 is depressed with respect to the platform 20, more room is provided for the nose of the drinker than would be the case if the platform 20 were absent. This permits a more natural drinking style to be used by the drinker.

What is claimed is:

1. A lid for a container, comprising:

a generally circular body member whose lower surface defines a first stacking plane;

sealing means on the periphery of said body member for securing said lid to the rim of a container;

a platform which is raised with respect to said body member and which covers a portion of said body member, said platform being located along a part of the periphery of said body member and occupying less than about one third of the area of said body member;

a depressible flipper valve located on said plaform, said valve being aligned in a generally radial direction and hinged towards the center of said body member;

an integrally formed protrusion located on said valve, said protrusion being utilized for the application of downward pressure on said valve; and a plurality of stacking lugs located on said body member, the upper surfaces of which are generally equal in elevation to the top of said protrusion with respect to said body member, the top of said protrusion and the upper surfaces of said stacking lugs defining a second stacking plane.

2. The lid of claim 1 wherein said platform is defined by a chord of said body member.

3. A lid for a container, comprising:

a generally circular body member whose lower surface defines a first stacking plane;

sealing means on the periphery of said body member for securing said lid to the rim of a container;

a raised platform integrally formed on a portion of said body member and being generally defined by the periphery of said body member and a chord of said body member;

a flipper valve located on said platform and generally radially aligned with respect to said body member, said valve being cantilevered so that it is hinges towards the center of said body member;

an integrally formed protrusion located on said valve; and a plurality of stacking lugs located on said body member, the upper surfaces of which are generally the same distance from said first stacking surface as is the top of said protrusion, the top of said protrusion and the upper surfaces of said stacking lugs thereby defining a second stacking plane.

4. A lid for a container, comprising:

a generally circular body member;

a platform integrally formed on said body member, said platform being bounded by the periphery of said body member and an upstanding wall portion which is generally defined by a chord of said body member, said wall portion connecting said platform to the remainder of said body member;

sealing means integrally formed along the periphery of said body member;

a flipper valve located on said platform, said flipper valve being generally radially aligned and hinged generally adjacent to said wall portion; and an integrally formed protrusion located on said flipper valve.

5. The lid of claim 3 or 4 wherein said lid is made of thermoformed plastic material.

* * * * *